United States Patent [19]

Gehin et al.

[11] 4,250,245

[45] Feb. 10, 1981

[54] CONTROL OF DYE RELEASE IN COLOR TRANSFER ASSEMBLAGES USING BLOCKED COMPETING DEVELOPERS

[75] Inventors: Guy Gehin, Ozoir-La-Ferriere; Eva Fage, Villiers-Sur-Marne, both of France

[73] Assignee: Eastman Kodak Company, Rochester, N.Y.

[21] Appl. No.: 67,588

[22] Filed: Aug. 17, 1979

Related U.S. Application Data

[63] Continuation-in-part of Ser. No. 956,826, Nov. 2, 1978, abandoned.

[30] Foreign Application Priority Data

Nov. 3, 1977 [FR] France ..... 77 32972

[51] Int. Cl.[3] ..... G03C 1/40; G03C 7/00; G03C 5/54; G03C 1/10

[52] U.S. Cl. ..... 430/218; 430/223; 430/239; 430/542; 430/543; 430/559

[58] Field of Search ..... 430/218, 223, 239, 559, 430/543, 542

[56] References Cited

U.S. PATENT DOCUMENTS

| | | | |
|---|---|---|---|
| 3,246,988 | 4/1966 | Porter et al. | 430/441 |
| 3,443,939 | 5/1969 | Bloom et al. | 430/223 |
| 3,462,266 | 8/1969 | Stewart | 430/441 |
| 3,816,126 | 6/1974 | Charkoudian | 430/218 |

OTHER PUBLICATIONS

"Photographic Processes and Products", *Research Disclosure* No. 15162, Nov. 1976, pp. 75–87.

*Primary Examiner*—Richard L. Schilling
*Attorney, Agent, or Firm*—Harold E. Cole

[57] ABSTRACT

Hydroquinone esters are incorporated in photographic elements for color diffusion transfer assemblages and release a competing developer upon contact with a processing composition, to terminate further dye release. The hydroquinone esters are employed in a concentration sufficient, upon hydrolysis, to reduce substantially all the silver in the silver halide emulsion.

27 Claims, No Drawings

CONTROL OF DYE RELEASE IN COLOR TRANSFER ASSEMBLAGES USING BLOCKED COMPETING DEVELOPERS

This invention relates to photography, and more particularly to photographic assemblages for color diffusion transfer photography wherein a hydroquinone ester is employed in a photographic element in a high concentration to release a competing developer upon contact with a processing composition, to terminate further dye release.

Various formats for color integral transfer elements are described in the prior art, such as U.S. Pat. Nos. 3,415,644; 3,415,645; 3,415,646; 3,647,437; 3,635,707; 3,756,815 and Canadian Pat. Nos. 928,559 and 674,082. In these formats, the image-receiving layer containing the photographic image for viewing can remain permanently attached and integral with the image generating and ancillary layers present in the structure when a transparent support is employed on the viewing side of the assemblage. The image is formed by dyes, produced in the image generating units, diffusing through the layers of the structure to the dye image-receiving layer. After exposure of the assemblage, an alkaline processing composition permeates the various layers to initiate development of the exposed photosensitive silver halide emulsion layers. The emulsion layers are developed in proportion to the extent of the respective exposures, and the image dyes which are formed or released in the respective image generating layers begin to diffuse throughout the structure. At least a portion of the imagewise distribution of diffusible dyes diffuse to the dye image-receiving layer to form an image of the original subject.

Other so-called "peel-apart" formats for color diffusion transfer assemblages are described, for example, in U.S. Pat. Nos. 2,983,606; 3,362,819; and 3,362,821. In these formats, the image-receiving element is separated from the photosensitive element after development and transfer of the dyes to the image-receiving layer.

U.S. Pat. No. 4,076,529 of Fleckenstein et al, issued Feb. 28, 1978, describes various color image transfer elements which employ nondiffusible, redox-dye-releasing compounds which are alkali-cleavable upon oxidation to release a diffusible color-providing moiety. As a function of development, an electron transfer agent becomes oxidized. The oxidized electron transfer agent then cross-oxidizes the dye-releasing compound. This is followed in turn by alkaline hydrolysis to release the dye.

Polymeric acid layers have generally been employed in these prior art systems as a "shut-down" mechanism to terminate silver halide development. While polymeric acid layers have proved to be satisfactory in many respects, it would be desirable to have a shut-down mechanism which responds to temperature changes in the same manner as the dye releaser. At high temperatures, such as 35° C., there is faster development with more dye being released, causing a significant loss in speed, an increase in $D_{max}$ and an increase in $D_{min}$. It would be desirable to have a shut-down mechanism which decreases the amount of dye release at higher temperatures.

In accordance with our invention, we have found that termination of the imaging reactions in a color diffusion transfer element may be achieved by using blocked competing developers incorporated into the photographic element in sufficient quantity to develop all of the silver present. The blocked hydroquinone esters are utilized in such a way as to provide an improvement in latitude of development time and processing temperature.

U.S. Patent Application Ser. No. 848,061 of Abbott, filed Nov. 3, 1977, and assigned to the same assignee as the instant application, relates to the use of a hydroquinone ester in or behind a particular timing layer, as a blocked competing developer. The use of such compounds in a photographic element as a shut-down mechanism is not disclosed in the Abbott application, however.

Competing developing agents have been used in various photographic assemblages heretofore, as shown, for example, in *Research Disclosure* 15162, November 1976. The blocked competing developers disclosed herein, however, are employed in different amounts, for a different purpose, and achieve a different result.

U.S. Pat. No. 3,462,266 relates to oxazines and bisoxazines which are cleaved to hydroquinones under alkaline conditions. The compounds are described as being auxiliary developer precursors in dye developer image transfer systems. Other halogenated acyl hydroquinone derivative developers are described in U.S. Pat. No. 3,246,988. The compounds in these patents release an active developer upon processing with an alkaline processing composition. The blocked hydroquinone esters in Applicants' invention are employed for an entirely different purpose and produce a different result.

U.S. Pat. No. 3,816,126 describes the use of certain alkyl and haloalkyl esters as an auxiliary developer in a diffusion transfer system, preferably employing a dye developer. This patent does not describe, however, the use of the particular compounds of the instant invention in the large amounts described herein for use as a shut-down mechanism in a color image transfer process employing ballasted, redox, dye-releasing compounds.

In accordance with our invention, a photographic element is provided which comprises a support having thereon at least one photosensitive silver halide emulsion layer having associated therewith a ballasted, redox-dye-releasing compound, the element containing a hydroquinone ester having the following formula:

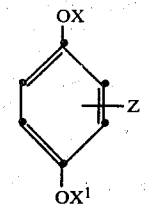

wherein:

X is hydrogen, COR or $SO_2R$;

$X^1$ is COR or $SO_2R$;

R is an alkyl (including substituted alkyl) group having from 1 to about 20 carbon atoms or an aryl (including substituted aryl) group having from 6 to about 12 carbon atoms; and Z is hydrogen, an alkyl (including substituted alkyl) group having from 1 to about 6 carbon atoms, an alkoxy group having from 1 to about 6 carbon atoms, or an aryl (including substituted aryl) group having from about 6 to about 8 carbon atoms;

the ester being present in a concentration sufficient, upon hydrolysis, to reduce substantially all the silver in the silver halide emulsion.

Upon processing the photographic element with an alkaline processing composition, which contains a developing agent capable of cross-oxidizing the dye-releasing compound as described above, the acyl or sulfonyl blocking groups are hydrolyzed to release the corresponding hydroquinone. This hydroquinone then acts as a competing developer with the cross-oxidizing developing agent. Dye is not released as a result of the functioning of the competing developer, however. The hydrolysis of the blocking group on the hydroquinone ester is relatively slow in comparison to the silver halide development and subsequent dye release. Thus, development of the silver halide by the competing developer predominates only after the faster reactions culminating in dye-release have gone to an optimum completion. When a conventional negative-working silver halide emulsion is used, all of the exposed silver halide is reduced by one or the other of these reactions. Because the released hydroquinone is a stronger reducing agent then the cross-oxidizing developing agent, further silver development by the cross-oxidizing developing agent is prevented. In addition, any unexposed silver halide grains which are also ultimately reduced by the hydroquinone do not produce dye. "Shut-down" is therefore achieved by use of this invention and post-processing dye-release is minimized. Very good image discrimination is therefore achieved. Since this shut-down reaction has a similar temperature dependence as the imaging reactions, dye release using the photographic elements of our invention are less sensitive to temperature variations.

In the above formula, Z can be hydrogen; an alkyl group of 1 to about 6 carbon atoms, such as methyl, ethyl, isopropyl, t-butyl, etc; an alkoxy group of 1 to about 6 carbon atoms, such as methoxy or ethoxy; or an aryl group having 6 to about 8 carbon atoms, such as phenyl, m-tolyl, p-methoxyphenyl, etc, as long as the compound will diffuse at a sufficient rate when the acyl or sulfonyl group or groups are hydrolyzed. In a similar manner, when each of X and $X^1$ in the formula is an acyl or sulfonyl group, any such group such as acetyl, propionyl, benzoyl, ethoxycarbonyl, ethoxalyl, methylsulfonyl, tolylsulfonyl, etc, can be employed, so long as it can be hydrolyzed to the corresponding hydroquinone.

As described above, the hydroquinone esters are employed in a concentration sufficient, upon hydrolysis, to reduce substantially all the silver in the silver halide emulsion. If the concentration is lower, the $D_{max}$ and development time latitude are substantially reduced, as will become apparent from the examples hereafter. Good results have been obtained when the hydroquinone ester is employed in a concentration of from about 4 to about 10 mg/dm$^2$ of photographic element.

The hydroquinone esters can be incorporated in any layer of the photographic element, such as the silver halide emulsion layer, the dye-releaser layer, interlayer, etc. Preferably, the hydroquinone ester is employed in the silver halide emulsion layer. When a three-color element is employed, each emulsion layer will have associated therewith the hydroquinone ester in the amount stated above.

Examples of hydroquinone esters useful in our invention include the following:

(1) Hydroquinone diacetate

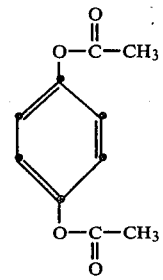

(2) Hydroquinone monohexanoate

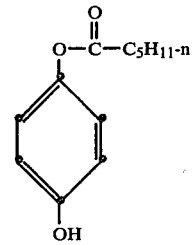

(3) 3-t-butyl-4-hydroxyphenyl acetate

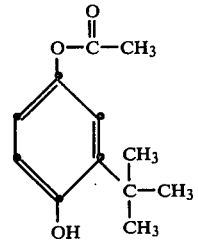

(4) Hydroquinone monoacetate

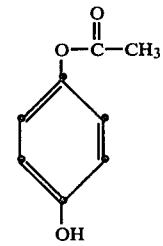

(5) Hydroquinone monobenzoate

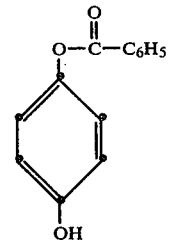

(6) 2-Methylhydroquinone monoacetate

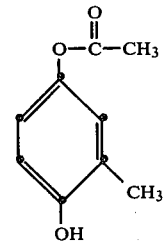

(7) 2-Methoxyhydroquinone monoacetate

-continued

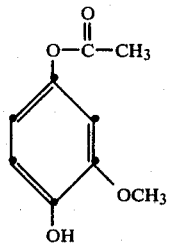

(8) 2-Methylhydroquinone monobenzoate

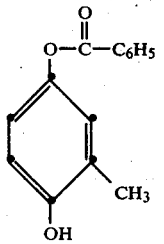

(9) 2-Methoxyhydroquinone monobenzoate

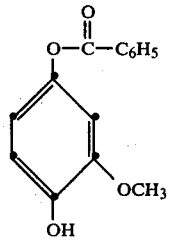

(10) 2-Ethoxyhydroquinone monoacetate

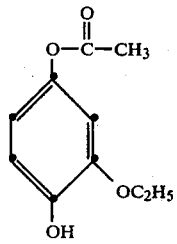

(11) 2-Ethoxyhydroquinone monobenzoate

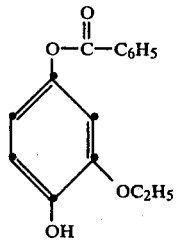

(12) p-Methylsulfonyloxyphenol

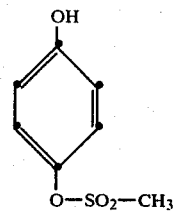

(13) p-Tolylsulfonyloxyphenol

-continued

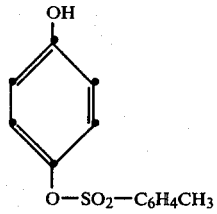

As stated above, the dye image-providing material employed in our invention is a ballasted, redox-dye-releasing (RDR) compound. Such compounds are well known to those skilled in the art and are, generally speaking, compounds which will redox with oxidized developing agent or electron transfer agent to release a dye, such as by alkaline hydrolysis, or prevent the release of dye, such as by intramolecular nucleophilic displacement. Such nondiffusible RDR's can be positive-working compounds, as described in U.S. Pat. No. 3,980,479, British Pat. No. 1,464,104 and U.S. Patent Application Ser. No. 775,025, filed Mar. 7, 1977 of Chasman et al. Such nondiffusible RDR's can also be negative-working compounds, as described in U.S. Pat. Nos. 3,728,113 of Becker et al; 3,725,062 of Anderson and Lum; 3,698,897 of Gompf and Lum; 3,628,952 of Puschel et al; 3,443,939 and 3,443,940 of Bloom et al; 4,053,312 of Fleckenstein; 4,076,529 of Fleckenstein et al; 4,055,428 of Koyama et al; German Pat. Nos. 2,505,248 and 2,729,820; *Research Disclosure* 15157, November, 1976; and *Research Disclosure* 15654, April, 1977.

In a preferred embodiment of our invention, the dye-releasers such as those in the Fleckenstein et al U.S. Pat. No. 4,076,529 are employed. In this embodiment, the dye-releasing compound is a ballasted sulfonamido compound which is alkali-cleavable upon oxidation to release a diffusible color-providing moiety from a benzene nucleus, the compound having the formula:

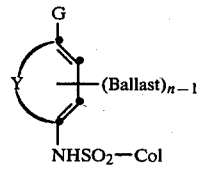

wherein:

Col is a dye or dye precursor moiety;

Ballast is an organic ballasting radical of such molecular size and configuration as to render the compound nondiffusible in the photosensitive element during development in an alkaline processing composition;

G is $OR_2$ or $NHR_3$ wherein $R_2$ is hydrogen or a hydrolyzable moiety and $R_3$ is hydrogen or an alkyl group of 1 to 22 carbon atoms;

Y represents the atoms necessary to complete a benzene nucleus, a naphthalene nucleus or a 5- to 7-membered heterocyclic ring; and n is a positive integer of 1 to 2 and is 2 when G is $OR_2$ or when $R_3$ is hydrogen or an alkyl group of less than 8 carbon atoms.

In a more preferred embodiment of our invention, the nondiffusible RDR's are ballasted p-sulfonamidonaphthol compounds, each of which has a color-providing moiety attached thereto through a sulfonamido group which is alkali-cleavable upon oxidation. For further details concerning the above-described sulfonamido compounds, including sulfonamidonaphthol compounds, and specific examples of same, reference is made to the above-mentioned Fleckenstein et al U.S. Pat. No. 4,076,529.

A process for producing a photographic image in color according to our invention comprises:

treating an imagewise-exposed photographic element, as described above, with an alkaline processing composition in the presence of a silver halide developing agent to effect development of each exposed silver halide emulsion layer, whereby:

(a) an imagewise distribution of dye is formed as a function of the development of the silver halide emulsion layer; and (b) at least a portion of the imagewise distribution of the dye diffuses out of the element, such as to a dye image-receiving layer.

A process for producing a photographic image in color according to our invention using a preferred element as described above wherein the nondiffusible RDR is a ballasted compound having a color-providing moiety attached thereto through a sulfonamido group which is alkali-cleavable upon oxidation comprises:

treating said element which has been imagewise-exposed with an alkaline processing composition in the presence of a silver halide developing agent to effect development of each exposed silver halide emulsion layer, whereby:

(a) the developing agent becomes oxidized;

(b) the oxidized developing agent cross-oxidizes the sulfonamido compound;

(c) the oxidized sulfonamido compound then cleaves, thus forming an imagewise distribution of the color-providing moiety as a function of the development of the silver halide emulsion layer; and (d) at least a portion of the imagewise distribution of the color-providing moiety diffuses out of the element, such as to a dye image-receiving layer.

It will be appreciated that, after processing the photographic elements described above, there remains in the elements, after transfer has taken place, an imagewise distribution of dye in addition to developed silver. A color image comprising residual nondiffusible compound may be obtained in these elements if the residual silver and silver halide are removed in any conventional manner well known to those skilled in the photographic art, such as a bleach bath followed by a fix bath, a bleach-fix bath, etc. The imagewise distribution of dye may also diffuse out of these elements into these baths, if desired, rather than to an image-receiving element.

The photographic element in the above-described processes can be treated with an alkaline processing composition to effect or initiate development in any manner. A preferred method for applying processing composition is by use of a rupturable container or pod which contains the composition. In general, the processing composition employed in this invention contains the developing agent for development, although the composition could also be solely an alkaline solution where the developer is incorporated in the photographic element, the image-receiving element or the process sheet, in which case the alkaline solution serves to activate the incorporated developer.

A photographic film unit or assemblage in accordance with this invention is adapted to be processed by an alkaline processing composition, and comprises:

(1) a photographic element as described above; and (2) a dye image-receiving layer.

In this embodiment, the processing composition may be inserted into the film unit, such as by interjecting processing solution with communicating members similar to hypodermic syringes which are attached either to a camera or camera cartridge. The processing composition may also be applied by means of a swab or by dipping in a bath, if so desired. In a preferred embodiment of the invention, the assemblage itself contains the alkaline processing composition and means containing same for discharge within the film unit, such as a rupturable container which is adapted to be positioned during processing of the film unit so that a compressive force applied to the container by pressure-applying members, such as would be found in a camera designed for in-camera processing, will effect a discharge of the container's contents within the film unit.

The dye image-receiving layer in the above-described film unit can be located on a separate support adapted to be superposed on the photographic element after exposure thereof. Such image-receiving elements are generally disclosed, for example, in U.S. Pat. No. 3,362,819. When the means for discharging the processing composition is a rupturable container, it is usually positioned in relation to the photographic element and the image-receiving element so that a compressive force applied to the container by pressure-applying members, such as would be found in a typical camera used for in-camera processing, will effect a discharge of the container's contents between the image-receiving element and the outermost layer of the photographic element. After processing, the dye image-receiving element is separated from the photographic element.

The dye image-receiving layer in the above-described film unit can also be located integral with the photographic element between the support and the lowermost photosensitive silver halide emulsion layer. One useful format for integral receiver-negative photographic elements is disclosed in Belgian Pat. No. 757,960. In such an embodiment, the support for the photographic element is transparent and is coated with an image-receiving layer, a substantially opaque light-reflective layer, e.g., $TiO_2$, and then the photosensitive layer or layers described above. After exposure of the photographic element, a rupturable container containing an alkaline processing composition and an opaque process sheet are brought into superposed position. Pressure-applying members in the camera rupture the container and spread processing composition over the photographic element as the film unit is withdrawn from the camera. The processing composition develops each exposed silver halide emulsion layer, and dye images, formed as a function of development, diffuse to the image-receiving layer to provide a positive, right-reading image which is viewed through the transparent support on the opaque reflecting layer background. For other details concerning the format of this particular integral film unit, reference is made to the above-mentioned Belgian Pat. No. 757,960.

Another format for integral negative-receiver photographic elements in which the present invention can be employed is disclosed in Belgian Pat. No. 757,959. In this embodiment, the support for the photographic element is transparent and is coated with the image-receiving layer, a substantially opaque, light-reflective layer and the photosensitive layer or layers described above. A rupturable container, containing an alkaline processing composition and an opacifier, is positioned between the top layer and a transparent cover sheet which has thereon a neutralizing layer and a timing layer. The film unit is placed in a camera, exposed through the transparent cover sheet and then passed through a pair of pressure-applying members in the camera as it is being removed therefrom. The pressure-applying members rupture the container and spread processing composition and opacifier over the negative portion of the film unit to render it light-insensitive. The processing composition develops each silver halide layer and dye images, formed as a result of development, diffuse to the image-receiving layer to provide a positive, right-reading image which is viewed through the transparent support on the opaque reflecting layer background. For further details concerning the format of this particular integral film unit, reference is made to the above-mentioned Belgian Pat. No. 757,959.

Still other useful integral formats in which this invention can be employed are described in U.S. Pat. Nos. 3,415,644; 3,415,645; 3,415,646; 3,647,437; and 3,635,707. In most of these formats, a photosensitive silver halide emulsion is coated on an opaque support, and a dye image-receiving layer is located on a separate transparent support superposed over the layer outermost from the opaque support. In addition, this transparent support also preferably contains a neutralizing layer and a timing layer underneath the dye image-receiving layer.

Another embodiment of the invention uses the image-reversing technique disclosed in British Pat. No. 904,364, page 19, lines 1 through 41. In this process, the dye-releasing compounds are used in combination with physical development nuclei in a nuclei layer contiguous to the photosensitive silver halide negative emulsion layer. The film unit contains a silver halide solvent, preferably in a rupturable container with the alkaline processing composition.

The film unit or assembly of the present invention may be used to produce positive images in single- or multicolors. In a three-color system, each silver halide emulsion layer of the film assembly will have associated therewith a dye image-providing material which possesses a predominant spectral absorption within the region of the visible spectrum to which said silver halide emulsion is sensitive, i.e., the blue-sensitive silver halide emulsion layer will have a yellow dye image-providing material associated therewith, the green-sensitive silver halide emulsion layer will have a magenta dye image-providing material associated therewith, and the red-sensitive silver halide emulsion layer will have a cyan dye image-providing material associated therewith. The dye image-providing material associated with each silver halide emulsion layer may be contained either in the silver halide emulsion layer itself or in a layer contiguous to the silver halide emulsion layer, i.e., the dye image-providing material may be coated in a separate layer underneath the silver halide emulsion layer with respect to the exposure direction.

The concentration of the dye image-providing material that is employed in the present invention may be varied over a wide range, depending upon the particular compound employed and the results desired. For example, the dye image-providing material may be coated in a layer at a concentration of 0.1 to 3 g/m$^2$. The dye image-providing material may be dispersed in a hydrophilic film-forming natural material or synthetic polymer, such as gelatin, polyvinyl alcohol, etc, which is adapted to be permeated by aqueous alkaline processing composition.

A variety of silver halide developing agents can be employed in this invention. Specific examples of developers or ETA compounds which can be employed in this invention include hydroquinone compounds, such as hydroquinone, 2,5-dichlorohydroquinone, 2-chlorohydroquinone and the like; aminophenol compounds, such as 4-aminophenol, N-methylaminophenol, N,N-dimethylaminophenol, 3-methyl-4-aminophenol, 3,5-dibromoaminophenol and the like; catechol compounds, such as catechol, 4-cyclohexylcatechol, 3-methoxycatechol, 4-(N-octadecylamino)catechol and the like; phenylenediamine compounds, such as N,N-diethyl-p-phenylenediamine, 3-methyl-N,N-diethyl-p-phenylenediamine, 3-methoxy-N-ethyl-N-ethoxy-p-phenylenediamine, N,N,N',N'-tetramethyl-p-phenylenediamine and the like. In highly preferred embodiments, the ETA is a 3-pyrazolidinone compound, such as 1-phenyl-3-pyrazolidinone (Phenidone), 1-phenyl-4,4-dimethyl-3-pyrazolidinone (Dimezone), 4-hydroxymethyl-4-methyl-1-phenyl-3-pyrazolidinone, 1-m-tolyl-3-pyrazolidinone, 1-p-tolyl-3-pyrazolidinone, 1-phenyl-4-methyl-3-pyrazolidinone, 1-phenyl-5-methyl-3-pyrazolidinone, 1-phenyl-4,4-bis-(hydroxymethyl)-3-pyrazolidinone, 1,4-dimethyl-3-pyrazolidinone, 4-methyl-3-pyrazolidinone, 4,4-dimethyl-3-pyrazolidinone, 1-(3-chlorophenyl)-4-methyl-3-pyrazolidinone, 1-(4-chlorophenyl)-4-methyl-3-pyrazolidinone, 1-(3-chlorophenyl)-3-pyrazolidinone, 1-(4-chlorophenyl)-3-pyrazolidinone, 1-(4-tolyl)-4-methyl-3-pyrazolidinone, 1-(2-tolyl)-4-methyl-3-pyrazolidinone, 1-(4-tolyl)-3-pyrazolidinone, 1-(3-tolyl)-3-pyrazolidinone, 1-(3-tolyl)-4,4-dimethyl-3-pyrazolidinone, 1-(2-trifluoroethyl)-4,4-dimethyl- 3-pyrazolidinone, 5-methyl-3-pyrazolidinone, and the like. A combination of different ETA's, such as those disclosed in U.S. Pat. No. 3,039,869, can also be employed. Such developing agents can be employed in the liquid processing composition or may be contained, at least in part, in any layer or layers of the photographic element or film unit to be activated by the alkaline processing composition, such as in the silver halide emulsion layers, the dye image-providing material layers, interlayers, image-receiving layer, etc.

In using dye image-providing materials in the invention which produce diffusible dye images as a function of development, either conventional negative-working or direct-positive silver halide emulsions may be employed. If the silver halide emulsion employed is a direct-positive silver halide emulsion, such as an internal-image emulsion designed for use in the internal image reversal process, or a fogged, direct-positive emulsion such as a solarizing emulsion, which is developable in unexposed areas, a positive image can be obtained on the dye image-receiving layer by using ballasted, redox, dye-releasers. After exposure of the film unit, the alkaline processing composition permeates the various layers to initiate development of the exposed photosensitive silver halide emulsion layers. The developing agent present in the film unit develops each of the silver halide emulsion layers in the unexposed areas (since the silver halide emulsions are direct-positive ones), thus causing the developing agent to become oxidized imagewise corresponding to the unexposed areas of the direct-positive silver halide emulsion layers. The oxidized developing agent then cross-oxidizes the dye-releasing compounds and the oxidized form of the compounds then undergoes a base-catalyzed reaction to release the dyes imagewise as a function of the imagewise exposure of each of the silver halide emulsion layers. At least a portion of the imagewise distributions of diffusible dyes diffuse to the image-receiving layer to form a positive image of the original subject. After being contacted by the alkaline processing composition, a pH-lowering layer in the film unit or image-receiving unit lowers the pH of the film unit or image receiver to stabilize the image.

Internal-image silver halide emulsions useful in this invention are described more fully in the November 1976 edition of *Research Disclosure,* pages 76 through 79, the disclosure of which is hereby incorporated by reference.

The various silver halide emulsion layers of a color film assembly employed in this invention can be disposed in the usual order, i.e., the blue-sensitive silver halide emulsion layer first with respect to the exposure side, followed by the green-sensitive and red-sensitive silver halide emulsion layers. If desired, a yellow dye layer or a yellow colloidal silver layer can be present between the blue-sensitive and green-sensitive silver halide emulsion layers for absorbing or filtering blue radiation that may be transmitted through the blue-sensitive layer. If desired, the selectively sensitized silver halide emulsion layers can be disposed in a different order, e.g., the blue-sensitive layer first with respect to the exposure side, followed by the red-sensitive and green-sensitive layers.

The rupturable container employed in certain embodiments of this invention can be of the type disclosed in U.S. Pat. Nos. 2,543,181; 2,643,886; 2,653,732; 2,723,051; 3,056,492; 3,056,491 and 3,152,515. In general, such containers comprise a rectangular sheet of fluid- and air-impervious material folded longitudinally upon itself to form two walls which are sealed to one another along their longitudinal and end margins to form a cavity in which processing solution is contained.

Generally speaking, except where noted otherwise, the silver halide emulsion layers employed in the invention comprise photosensitive silver halide dispersed in gelatin and are about 0.6 to 6 microns in thickness; the dye image-providing materials are dispersed in an aqueous alkaline solution-permeable polymeric binder, such as gelatin, as a separate layer about 0.2 to 7 microns in thickness; and the alkaline solution-permeable polymeric interlayers, e.g., gelatin, are about 0.2 to 5 microns in thickness. Of course, these thicknesses are approximate only and can be modified according to the product desired.

Any material can be employed as the image-receiving layer in this invention as long as the desired function of mordanting or otherwise fixing the dye images is obtained. The particular material chosen will, of course, depend upon the dye to be mordanted. Suitable materials are disclosed on pages 80 through 82 of the November 1976 edition of *Research Disclosure,* the disclosure of which is hereby incorporated by reference.

Use of a pH-lowering material in the film units of this invention will usually increase the stability of the transferred image. Generally, the pH-lowering material will effect a reduction in the pH of the image layer from about 13 or 14 to at least 11 and preferably 5 to 8 within a short time after inbibition. Suitable materials and their functions are disclosed on pages 22 and 23 of the July 1974 edition of *Research Disclosure,* and pages 35 through 37 of the July 1975 edition of *Research Disclosure,* the disclosures of which are hereby incorporated by reference.

A timing or inert spacer layer can be employed in the practice of this invention over the pH-lowering layer which "times" or controls the pH reduction as a function of the rate at which the alkaline composition diffuses through the inert spacer layer. Examples of such timing layers and their functions are disclosed in the *Research Disclosure* articles mentioned in the paragraph above concerning pH-lowering layers.

The alkaline processing composition employed in this invention is the conventional aqueous solution of an alkaline material, e.g., alkali metal hydroxides or carbonates such as sodium hydroxide, sodium carbonate or an amine such as diethylamine, preferably possessing a pH in excess of 11, and preferably containing a developing agent as described previously. Suitable materials and addenda frequently added to such compositions are disclosed on pages 79 and 80 of the November 1976 edition of *Research Disclosure,* the disclosure of which is hereby incorporated by reference.

The alkaline solution-permeable, substantially opaque, light-reflective layer employed in certain embodiments of photographic film units used in this invention are described more fully in the November 1976 edition of *Research Disclosure,* page 82, the disclosure of which is hereby incorporated by reference.

The supports for the photographic elements used in this invention can be any material, as long as it does not deleteriously affect the photographic properties of the film unit and is dimensionally stable. Typical flexible sheet materials are described on page 85 of the November 1976 edition of *Research Disclosure,* the disclosure of which is hereby incorporated by reference.

While the invention has been described with reference to layers of silver halide emulsions and dye image-providing materials, dotwise coating, such as would be obtained using a gravure printing technique, could also be employed. In this technique, small dots of blue-, green- and red-sensitive emulsions have associated therewith, respectively, dots of yellow, magenta and cyan color-providing substances. After development, the transferred dyes would tend to fuse together into a continuous tone.

The silver halide emulsions useful in this invention, both negative-working and direct-positive ones, are well known to those skilled in the art and are described in *Product Licensing Index,* Volume 92, December 1971, publication 9232, page 107, paragraph I, "Emulsion types"; they may be chemically and spectrally sensitized as described on page 107, paragraph III, "Chemical sensitization", and pages 108 and 109, paragraph XV, "Spectral sensitization", of the above article; they can be protected against the production of fog and can be stabilized against loss of sensitivity during keeping by employing the materials described on page 107, paragraph V, "Antifoggants and stabilizers", of the above article; they can contain development modifiers, hardeners, and coating aids as described on pages 107 and 108, paragraph IV, "Development modifiers"; paragraph VII, "Hardeners"; and paragraph XII, "Coating aids", of the above article; they and other layers in the photographic elements used in this invention can contain plasticizers, vehicles and filter dyes described on page 108, paragraph XI, "Plasticizers and lubricants", and paragraph VIII, "Vehicles", and page 109, paragraph XVI, "Absorbing and filter dyes", of the above article; they and other layers in the photographic elements used in this invention may contain addenda which are incorporated by using the procedures described on page 109, paragraph XVII, "Methods of addition", of the above article; and they can be coated by using the various techniques described on page 109, paragraph XVIII, "Coating procedures", of the above article, the disclosures of which are hereby incorporated by reference.

The term "nondiffusing" used herein has the meaning commonly applied to the term in photography and denotes materials that for all practical purposes do not migrate or wander through organic colloid layers, such as gelatin, in the photographic elements of the invention in an alkaline medium and preferably when processed in a medium having a pH of 11 or greater. The same meaning is to be attached to the term "immobile". The term "diffusible" as applied to the materials of this invention has the converse meaning and denotes materials having the property of diffusing effectively through the colloid layers of the photographic elements in an alkaline medium. "Mobile" has the same meaning as "diffusible".

The term "associated therewith" as used herein is intended to mean that the materials can be in either the same or different layers, so long as the materials are accessible to one another.

The following examples are provided to further illustrate the invention.

EXAMPLE 1—Preparation and Testing of Retained Image Element (A). A photographic element (A) was prepared by coating the following layers in the order recited on a poly(ethylene terephthalate) film support. Quantities are parenthetically given in mg/dm$^2$.

(1) Magenta RDR* (10.8) and green-sensitive, negative, silver bromoiodide emulsion [silver (10) and gelatin (15)], and 4-methyl-4-hydroxymethyl-1-phenyl-3-pyrazolidinone developing agent (0.5);

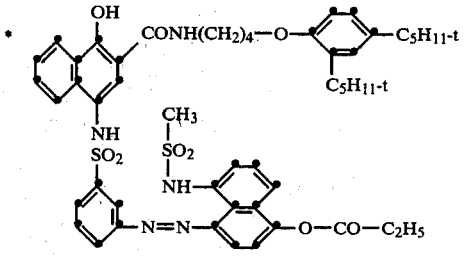

and (2) Gelatin overcoat (8).

(B). Photographic element (B) was prepared which was the same as element (A), except that layer (2) contained Compound 8 described above (6.9).

(C). Photographic element (C) was prepared which was the same as element (A), except that layer (2) contained Compound 6 described above (5).

Samples of each of the above-prepared photosensitive elements were given a green exposure in a sensitometer. The exposed samples were then processed at 20° C. for 1, 2 and 5 minutes by rupturing a pod containing a viscous processing composition between the photosensitive element and a dye image-receiving element as described below. The thickness of the processing composition layer was 0.14 mm.

The processing composition was as follows:

Potassium hydroxide—40 g
Potassium bromide—10 g
11-Aminoundecanoic acid—10 g
Oxalic acid—5 g
Hydroxyethylcellulose—30 g
Water to make 1 liter The dye image-receiving element consisted of a paper support having thereon the following mordant in gelatin:

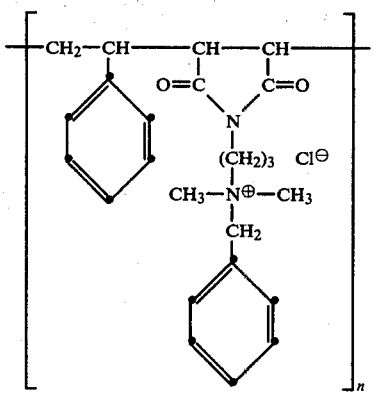

In the exposed areas of the photographic element, the magenta RDR is oxidized by the oxidized developing agent, and then in the alkaline medium releases a magenta dye which diffuses to the dye image-receiving layer. A retained magenta image is obtained which is positive with respect to the original. The following sensitometric results on the retained image of the photographic element were obtained:

TABLE I

| Element | Processing Time: 1 Minute $D_{max}$ | 1 Minute $D_{min}$ | 1 Minute ΔD | 2 Minutes $D_{max}$ | 2 Minutes $D_{min}$ | 2 Minutes ΔD | 5 Minutes $D_{max}$ | 5 Minutes $D_{min}$ | 5 Minutes ΔD |
|---|---|---|---|---|---|---|---|---|---|
| A (Control) | 2.7 | 1.3 | 1.4 | 2.7 | 0.2 | 2.5 | 0.1 | 0.1 | 0 |
| B | 2.4 | 0.2 | 2.2 | 2.4 | 0.2 | 2.2 | 2.0 | 0.5 | 1.5 |
| C | 2.5 | 0.8 | 1.7 | 2.5 | 0.8 | 1.7 | 1.9 | 0.7 | 1.2 |

The results indicate that the color discrimination (difference between $D_{max}$ and $D_{min}$ or ΔD) decreased rapidly for the control element as the development time was increased, and became nil at 5 minutes. The color discrimination of the elements of the invention, however, diminished much more slowly as the development time was increased. The photographic elements of the invention thus exhibit a greater latitude as regards the development time.

As indicated above, the hydroquinone released from the hydroquinone ester develops silver in the unexposed areas, as well as in the exposed areas, without the concurrent release of dye. The amount of developed silver was measured in the photographic elements as follows:

| Element | DEVELOPED SILVER Processing Time 1 Minute Exposed Areas | 1 Minute Unexposed Areas | 2 Minutes Exposed Areas | 2 Minutes Unexposed Areas | 5 Minutes Exposed Areas | 5 Minutes Unexposed Areas |
|---|---|---|---|---|---|---|
| A (Control) | 1.5 | 0.03 | 2.38 | 0.15 | 4.35 | 2.98 |
| B | 4.5 | 0.32 | 6.25 | 1.05 | 7.94 | 4.00 |
| C | 6.10 | 0.35 | 6.92 | 0.84 | 7.71 | 4.85 |

EXAMPLE 2—Processing Temperature Variation of Retained Image Element

Example 1 was repeated, except that samples of elements (A), (B) and (C) were processed for 2 minutes at 20° C., 25° C. and 30° C. The following sensitometric results on the retained image of the photographic elements were obtained:

TABLE III

| Element | Processing Temperature 20° C. $D_{max}$ | 20° C. $D_{min}$ | 20° C. ΔD | 25° C. $D_{max}$ | 25° C. $D_{min}$ | 25° C. ΔD | 30° C. $D_{max}$ | 30° C. $D_{min}$ | 30° C. ΔD |
|---|---|---|---|---|---|---|---|---|---|
| A (Control) | 2.7 | 0.15 | 2.55 | 0.15 | 0.15 | 0 | 0.15 | 0.15 | 0 |
| B | 2.4 | 0.2 | 2.2 | 1.8 | 0.2 | 1.6 | 1.6 | 0.4 | 1.2 |
| C | 2.7 | 0.7 | 2.0 | 2.1 | 0.5 | 1.6 | 1.6 | 0.5 | 1.1 |

The results indicate that the control element was very sensitive to an increase in processing temperature, and the color discrimination became nil at 25° C. The color discrimination of the elements of the invention, however, were much less sensitive to an increase in the processing temperature. The photographic elements of the invention thus exhibit a greater processing temperature latitude.

EXAMPLE 3—Concentration Variation of Hydroquinone Ester-Retained Image Element (D). A photographic element (D) was prepared by coating the following layers in the order recited on a poly(ethylene terephthalate) film support. Quantities are parenthetically given in mg/dm².

(1) Magenta RDR of Example 1 (8.7); and (2) Green-sensitive, negative silver bromoiodide emulsion [silver (10) and gelatin (15)], and 4-methyl-4-hydroxymethyl-1-phenyl-3-pyrazolidinone developing agent (0.5).

(E). Photographic element (E) was prepared which was the same as element (D), except that layer (2) contained compound 6 described above (0.8). (This amount is insufficient to reduce all the silver in the silver halide emulsion.)

(F). Photographic element (F) was prepared which was the same as element (D), except that layer (2) contained compound 6 described above (5).

Samples of each of the above-prepared photosensitive elements were exposed and processed as in Example 1 at 20° C., but with development times of 45 seconds, 1, 2 and 5 minutes. The following sensitometric results on the retained image of the photographic element were obtained:

TABLE IV

| Element | Amount of Compound 6 mg/dm² | Processing Time 45 Seconds $D_{max}$ | 45 Seconds $D_{min}$ | 45 Seconds ΔD | 1 Minute $D_{max}$ | 1 Minute $D_{min}$ | 1 Minute ΔD | 2 Minutes $D_{max}$ | 2 Minutes $D_{min}$ | 2 Minutes ΔD | 5 Minutes $D_{max}$ | 5 Minutes $D_{min}$ | 5 Minutes ΔD |
|---|---|---|---|---|---|---|---|---|---|---|---|---|---|
| D (Control) | 0 | 3.0 | 1.2 | 1.8 | 2.6 | 0.4 | 2.2 | 2.2 | 0.2 | 1.8 | 0.2 | 0.2 | 0 |
| E (Control) | 0.8 | 1.5 | 0.1 | 1.4 | 1.3 | 0.1 | 1.2 | 0.9 | 0.1 | 0.8 | 0.5 | 0.1 | 0.4 |
| F | 5 | 2.7 | .65 | 2.05 | 2.6 | 0.8 | 1.8 | 2.4 | 0.7 | 1.7 | 2.2 | 0.7 | 1.5 |

The results indicate that the color discrimination decreased rapidly for the control element (D) as the development time was increased, and became nil at 5 minutes. For the control element (E) which contained an amount of compound 6 which is insufficient to reduce all of the silver in the silver halide emulsion, the $D_{max}$ was relatively low and the color discrimination also decreased rapidly as the development time was increased. The color discrimination of element (F) of the invention, however, decreased much more slowly as the development time was increased. The photographic element of the invention thus exhibits a greater latitude in development time.

EXAMPLE 4—PROCESSING TEMPERATURE AND CONCENTRATION VARIATION OF HYDROQUINONE ESTER-RETAINED IMAGE ELEMENT

Example 3 was repeated, except that samples of elements (D), (E) and (F) were processed for 2 minutes at 20° C., 25° C. and 30° C. The following sensitometric results on the retained image of the photographic element were obtained:

TABLE V

| Element | Amount of Compound 6 mg/dm² | Processing Temperature 20° C. $D_{max}$ | 20° C. $D_{min}$ | 20° C. ΔD | 25° C. $D_{max}$ | 25° C. $D_{min}$ | 25° C. ΔD | 30° C. $D_{max}$ | 30° C. $D_{min}$ | 30° C. ΔD |
|---|---|---|---|---|---|---|---|---|---|---|
| D (Control) | 0 | 2.0 | 0.2 | 1.8 | 1.2 | 0.2 | 1.0 | 0.2 | 0.2 | 0 |
| E (Control) | 0.8 | 0.9 | 0.2 | 0.7 | 0.6 | 0.2 | 0.4 | 0.35 | 0.2 | 0.15 |
| F | 5 | 2.4 | 0.7 | 1.7 | 2.4 | 0.6 | 1.8 | 2.2 | 0.4 | 1.8 |

The results indicate that control element (D) was very sensitive to an increase in processing temperature, and the color discrimination became nil at 30° C. For control element (E), the $D_{max}$ was relatively low and the color discrimination also decreased rapidly as the development temperature was increased. The color discrimination of element (F) of the invention, however, did not decrease with increasing development temperatures, and thus had a greater latitude in this respect.

EXAMPLE 5—CONCENTRATION VARIATION OF HYDROQUINONE ESTER-TRANSFERRED IMAGE

Samples of elements (D), (E) and (F) of Example 3 were exposed and processed as in Example 1, except that the following processing composition was used:

Potassium hydroxide—40 g
Potassium bromide—10 g
Hydroxyethylcellulose—30 g
Water to make 1 liter Processing took place at 20° C. for 45 seconds, 1, 2 and 5 minutes. The following sensitometric results on the image transferred to the dye image-receiving element were obtained:

TABLE VI

| Photographic Element | Amount of Compound 6 mg/dm² | TRANSFERRED IMAGE Processing Time 45 seconds $D_{max}$ | $D_{min}$ | ΔD | 1 Minute $D_{max}$ | $D_{min}$ | ΔD | 2 Minutes $D_{max}$ | $D_{min}$ | ΔD | 5 Minutes $D_{max}$ | $D_{min}$ | ΔD |
|---|---|---|---|---|---|---|---|---|---|---|---|---|---|
| D (Control) | 0 | 1.9 | 0.3 | 1.6 | 2.2 | 0.4 | 1.8 | 2.5 | 0.8 | 1.7 | 2.5 | 2.3 | 0.2 |
| E (Control) | 0.8 | 2.4 | 0.3 | 2.1 | 2.4 | 0.4 | 2.0 | 2.5 | 0.7 | 1.8 | 2.5 | 0.95 | 1.55 |
| F | 5 | 2.0 | 0.25 | 1.75 | 2.1 | 0.25 | 1.85 | 2.3 | 0.3 | 2.0 | 2.4 | 0.55 | 1.85 |

The results indicate that the color discrimination decreased rapidly for the control element (D) as the development time was increased and became substantially nil at 5 minutes. For the control element (E), the $D_{min}$ increased with increased processing time, while the color discrimination decreased. For the element (F) of the invention, however, the color discrimination did not decrease with increased processing time, and thus has a greater latitude in this aspect.

EXAMPLE 6—PROCESSING TEMPERATURE AND CONCENTRATION VARIATION OF HYDROQUINONE ESTER-TRANSFERRED IMAGE

Example 5 was repeated, except that samples of elements (D), (E) and (F) were processed for 2 minutes at 20° C., 30° C. and 40° C. The following sensitometric results on the image transferred to the dye image-receiving element were obtained:

TABLE VII

| Element | Amount of Compound 6 mg/dm² | TRANSFERRED IMAGE Processing Temperature 20° C. $D_{max}$ | $D_{min}$ | ΔD | 30° C. $D_{max}$ | $D_{min}$ | ΔD | 40° C. $D_{max}$ | $D_{min}$ | ΔD |
|---|---|---|---|---|---|---|---|---|---|---|
| D (Control) | 0 | 2.5 | 0.8 | 1.7 | 2.5 | 2.2 | 0.3 | 2.5 | 2.5 | 0 |
| E (Control) | 0.8 | 2.45 | 0.7 | 1.75 | 2.5 | 1.4 | 1.1 | 2.5 | 2.35 | 0.15 |
| F | 5 | 2.3 | 0.3 | 2.0 | 2.5 | 0.5 | 2.0 | 2.5 | 1.2 | 1.3 |

The results indicate that control element (D) was very sensitive to an increase in processing temperature, and the color discrimination became nil at 40° C. For control element (E), the color discrimination also decreased rapidly as the development temperature was increased. The color discrimination of the element (F) of the invention, however, was substantially higher than the control elements at all processing temperatures, and thus has a greater latitude in development temperatures.

The invention has been described in detail with particular reference to preferred embodiments thereof, but it will be understood that variations and modifications can be effected within the spirit and scope of the invention.

What is claimed is:

1. In a photographic element comprising a support having thereon at least one photosensitive silver halide emulsion layer having associated therewith a ballasted, redox-dye-releasing compound, the improvement wherein said emulsion layer contains a hydroquinone ester having the following formula:

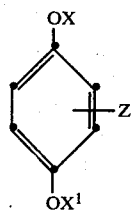

wherein:

X is hydrogen, COR or $SO_2R$;
$X^1$ is COR or $SO_2R$;
R is an alkyl group having from 1 to about 20 carbon atoms or an aryl group having from 6 to about 12 carbon atoms; and
Z is hydrogen, an alkyl group having from 1 to about 6 carbon atoms, an alkoxy group having from 1 to about 6 carbon atoms, or an aryl group having from about 6 to about 8 carbon atoms;

said ester being present in a concentration sufficient, upon hydrolysis, to reduce substantially all the silver in said silver halide emulsion.

2. The photographic element of claim 1 wherein said hydroquinone ester is 2-methylhydroquinone monoacetate, 2-methoxyhydroquinone monoacetate, 2-methylhydroquinone monobenzoate, 2-methoxyhydroquinone monobenzoate, hydroquinone diacetate, hydroquinone monoacetate, hydroquinone monohexanoate, 3-t-butyl-4-hydroxyphenyl acetate, hydroquinone monobenzoate, 2-ethoxyhydroquinone monoacetate, 2-ethoxyhydroquinone monobenzoate, p-methylsulfonyloxyphenol or p-tolylsulfonyloxyphenol.

3. The photographic element of claim 1 wherein said hydroquinone ester is present in a concentration of from about 4 to about 10 mg/dm².

4. The photographic element of claim 1 wherein said dye-releasing compound is a ballasted sulfonamido compound which is alkali-cleavable upon oxidation to release a diffusible color-providing moiety from a benzene nucleus, said compound having the formula:

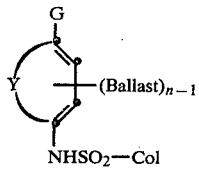

wherein:

Col is a dye or dye precursor moiety;

Ballast is an organic ballasting radical of such molecular size and configuration as to render said compound nondiffusible in said photographic element during development in an alkaline processing composition;

G is $OR_2$ or $NHR_3$ wherein $R_2$ is hydrogen or a hydrolyzable moiety and $R_3$ is hydrogen or an alkyl group of 1 to 22 carbon atoms;

Y represents the atoms necessary to complete a benzene nucleus, a naphthalene nucleus or a 5- to 7-membered heterocyclic ring; and n is a positive integer of 1 to 2 and is 2 when G is $OR_2$ or when $R_3$ is hydrogen or an alkyl group of less than 8 carbon atoms.

5. The photographic element of claim 4 wherein said dye-releasing compound is a p-sulfonamidonaphthol.

6. The photographic element of claim 1 wherein said hydroquinone ester is 2-methylhydroquinone monobenzoate.

7. The photographic element of claim 1 wherein said hydroquinone ester is hydroquinone monoacetate.

8. In a photographic element comprising a support having thereon a red-sensitive silver halide emulsion layer having a ballasted, redox, cyan dye-releasing compound associated therewith, a green-sensitive silver halide emulsion layer having a ballasted, redox, magenta dye-releasing compound associated therewith, and a blue-sensitive silver halide emulsion layer having a ballasted, redox, yellow dye-releasing compound associated therewith, the improvement wherein each said emulsion layer contains a hydroquinone ester having the following formula:

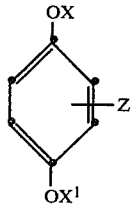

wherein:

X is hydrogen, COR or $SO_2R$;

$X^1$ is COR or $SO_2R$;

R is an alkyl group having from 1 to about 20 carbon atoms or an aryl group having from 6 to about 12 carbon atoms; and Z is hydrogen, an alkyl group having from 1 to about 6 carbon atoms, an alkoxy group having from 1 to about 6 carbon atoms, or an aryl group having from about 6 to about 8 carbon atoms;

said ester being present in a concentration sufficient, upon hydrolysis, to reduce substantially all the silver in each said silver halide emulsion.

9. The photographic element of claim 8 wherein said hydroquinone ester is 2-methylhydroquinone monoacetate, 2-methoxyhydroquinone monoacetate, 2-methylhydroquinone monobenzoate, 2-methoxyhydroquinone monobenzoate, hydroquinone diacetate, hydroquinone monoacetate, hydroquinone monohexanoate, 3-t-butyl-4-hydroxyphenyl acetate, hydroquinone monobenzoate, 2-ethoxyhydroquinone monoacetate, 2-ethoxyhydroquinone monobenzoate, p-methylsulfonyloxyphenol or p-tolylsulfonyloxyphenol.

10. The photographic element of claim 8 wherein said hydroquinone ester is present in a concentration of from about 4 to about 10 mg/dm$^2$.

11. In a photographic assemblage to be processed by an alkaline processing composition, said assemblage comprising:

(a) a photographic element comprising a support having thereon at least one photosensitive silver halide emulsion layer having associated therewith a ballasted, redox-dye-releasing compound; and (b) a dye image-receiving layer;

the improvement wherein said emulsion layer contains a hydroquinone ester having the following formula:

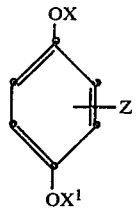

wherein

X is hydrogen, COR or $SO_2R$;

$X^1$ is COR or $SO_2R$;

R is an alkyl group having from 1 to about 20 carbon atoms or an aryl group having from 6 to about 12 carbon atoms; and Z is hydrogen, an alkyl group having from 1 to about 6 carbon atoms, an alkoxy group having from 1 to about 6 carbon atoms, or an aryl group having from about 6 to about 8 carbon atoms;

said ester being present in a concentration sufficient, upon hydrolysis, to reduce substantially all the silver in said silver halide emulsion.

12. In a photographic assemblage comprising:

(a) a photographic element comprising a support having thereon at least one photosensitive silver halide emulsion layer having associated therewith a ballasted, redox-dye-releasing compound;

(b) a dye image-receiving layer; and (c) an alkaline processing composition and means for discharging same within said assemblage;

said assemblage containing a silver halide developing agent, the improvement wherein said emulsion layer contains a hydroquinone ester having the following formula:

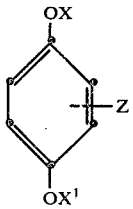

wherein:

X is hydrogen, COR or $SO_2R$;

$X^1$ is COR or $SO_2R$;

R is an alkyl group having from 1 to about 20 carbon atoms or an aryl group having from 6 to about 12 carbon atoms; and Z is hydrogen, an alkyl group having from 1 to about 6 carbon atoms, an alkoxy group having from 1 to about 6 carbon atoms, or an aryl group having from about 6 to about 8 carbon atoms;

said ester being present in a concentration sufficient, upon hydrolysis, to reduce substantially all the silver in said silver halide emulsion.

13. The assemblage of claim 12 wherein:

(a) said dye image-receiving layer is located between said support and said silver halide emulsion layer; and (b) said assemblage also includes a transparent cover sheet over the layer outermost from said support.

14. The assemblage of claim 13 wherein said cover sheet has thereon, in sequence, a neutralizing layer and a timing layer.

15. The assemblage of claim 14 wherein said discharging means is a rupturable container containing said alkaline processing composition and an opacifying agent, said container being so positioned during processing of said assemblage that a compressive force applied to said container will effect a discharge of the container's contents between said transparent sheet and the layer outermost from said support.

16. In a photographic assemblage comprising:

(a) a photographic element comprising a support having thereon a red-sensitive silver halide emulsion layer having associated therewith a ballasted, redox, cyan dye-releasing compound, a green-sensitive silver halide emulsion layer having associated therewith a ballasted, redox, magenta dye-releasing compound, and a blue-sensitive silver halide emulsion layer having associated therewith a ballasted, redox, yellow dye-releasing compound;

(b) a dye image-receiving layer; and (c) an alkaline processing composition and means containing same for discharge within said assemblage;

said assemblage containing a silver halide developing agent, the improvement wherein each said emulsion layer contains a hydroquinone ester having the following formula:

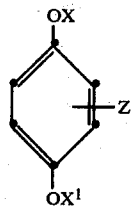

wherein:

X is hydrogen, COR or $SO_2R$;

$X^1$ is COR or $SO_2R$;

R is an alkyl group having from 1 to about 20 carbon atoms or an aryl group having from 6 to about 12 carbon atoms; and Z is hydrogen, an alkyl group having from 1 to about 6 carbon atoms, an alkoxy group having from 1 to about 6 carbon atoms, or an aryl group having from about 6 to about 8 carbon atoms;

said ester being present in a concentration sufficient, upon hydrolysis, to reduce substantially all the silver in each said silver halide emulsion.

17. The photographic assemblage of claim 16 wherein said hydroquinone ester is 2-methylhydroquinone monoacetate, 2-methoxyhydroquinone monoacetate, 2-methylhydroquinone monobenzoate, 2-methoxyhydroquinone monobenzoate, hydroquinone diacetate, hydroquinone monoacetate, hydroquinone monohexanoate, 3-t-butyl-4-hydroxyphenyl acetate, hydroquinone monobenzoate, 2-ethoxyhydroquinone monoacetate, 2-ethoxyhydroquinone monobenzoate, p-methylsulfonyloxyphenol or p-tolylsulfonyloxyphenol.

18. The photographic assemblage of claim 16 wherein said hydroquinone ester is present in a concentration of from about 4 to about 10 $mg/dm^2$.

19. The photographic assemblage of claim 16 wherein said dye-releasing compound is a ballasted sulfonamido compound which is alkali-cleavable upon oxidation to release a diffusible color-providing moiety from a benzene nucleus, said compound having the formula:

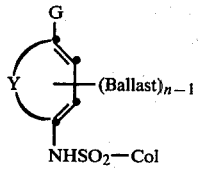

wherein:

Col is a dye or dye precursor moiety;

Ballast is an organic ballasting radical of such molecular size and configuration as to render said compound nondiffusible in said photographic element during development in an alkaline processing composition;

G is $OR_2$ or $NHR_3$ wherein $R_2$ is hydrogen or a hydrolyzable moiety and $R_3$ is hydrogen or an alkyl group of 1 to 22 carbon atoms;

Y represents the atoms necessary to complete a benzene nucleus, a naphthalene nucleus or a 5- to 7-membered heterocyclic ring; and n is a positive integer of 1 to 2 and is 2 when G is $OR_2$ or when $R_3$ is hydrogen or an alkyl group of less than 8 carbon atoms.

20. The photographic assemblage of claim 19 wherein said dye-releasing compound is a p-sulfonamidonaphthol.

21. In an integral photographic assemblage comprising:

(a) a photosensitive element comprising a transparent support having thereon the following layers in sequence: a dye image-receiving layer, an alkaline solution-permeable, light-reflective layer, an alkaline solution-permeable, opaque layer, a red-sensitive silver halide emulsion layer having associated therewith a ballasted, redox, cyan dye-releasing compound, a green-sensitive silver halide emulsion layer having associated therewith a ballasted, redox, magenta dye-releasing compound, and a blue-sensitive silver halide emulsion layer having associated therewith a ballasted, redox, yellow dye-releasing compound;

(b) a transparent sheet superposed over said blue-sensitive silver halide emulsion layer and comprising a transparent support having thereon, in sequence, a neutralizing layer and a timing layer; and (c) a rupturable container containing an alkaline processing composition and an opacifying agent which is so positioned during processing of said assemblage that a compressive force applied to said container will effect a discharge of the container's contents between said transparent sheet and said blue-sensitive silver halide emulsion layer;

said assemblage containing a silver halide developing agent, the improvement wherein each said emulsion layer contains a hydroquinone ester having the following formula:

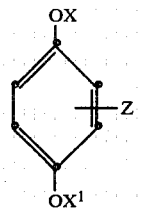

wherein:

X is hydrogen, COR or $SO_2R$;

$X^1$ is COR or $SO_2R$;

R is an alkyl group having from 1 to about 20 carbon atoms or an aryl group having from 6 to about 12 carbon atoms; and Z is hydrogen, an alkyl group having from 1 to about 6 carbon atoms, an alkoxy group having from 1 to about 6 carbon atoms, or an aryl group having from about 6 to about 8 carbon atoms;

said ester being present in a concentration sufficient, upon hydrolysis, to reduce substantially all the silver in each said silver halide emulsion.

22. In a process for producing a photographic image in color in an imagewise-exposed photographic element comprising a support having thereon at least one photosensitive silver halide emulsion layer having associated therewith a ballasted, redox-dye-releasing compound, said process comprising:

treating said element with an alkaline processing composition in the presence of a silver halide developing agent to effect development of each exposed silver halide emulsion layer, whereby:

(a) an imagewise distribution of said dye is formed as a function of said development of said silver halide emulsion layer; and (b) at least a portion of said imagewise distribution of said dye diffuses out of said element, the improvement wherein said emulsion layer contains a hydroquinone ester having the following formula:

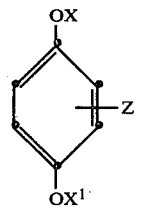

wherein:

X is hydrogen, COR or $SO_2R$;

$X^1$ is COR or $SO_2R$;

R is an alkyl group having from 1 to about 20 carbon atoms or an aryl group having from 6 to about 12 carbon atoms; and Z is hydrogen, an alkyl group having from 1 to about 6 carbon atoms, an alkoxy group having from 1 to about 6 carbon atoms, or an aryl group having from about 6 to about 8 carbon atoms;

said ester being present in a concentration sufficient, upon hydrolysis, to reduce substantially all the silver in said silver halide emulsion.

23. The process of claim 22 wherein said imagewise distribution of said dye diffuses to a dye image-receiving layer.

24. The process of claim 22 wherein said hydroquinone ester is 2-methylhydroquinone monoacetate, 2-methoxyhydroquinone monoacetate, 2-methylhydroquinone monobenzoate, 2-methoxyhydroquinone monobenzoate, hydroquinone diacetate, hydroquinone monoacetate, hydroquinone monohexanoate, 3-t-butyl-4-hydroxyphenyl acetate, hydroquinone monobenzoate, 2-ethoxyhydroquinone monoacetate, 2-ethoxyhydroquinone monobenzoate, p-methylsulfonyloxyphenol or p-tolylsulfonyloxyphenol.

25. The process of claim 22 wherein said hydroquinone ester is present in a concentration of from about 4 to about 10 $mg/dm^2$.

26. The process of claim 22 wherein said dye-releasing compound is a ballasted sulfonamido compound which is alkali-cleavable upon oxidation to release a diffusible color-providing moiety from a benzene nucleus, said compound having the formula:

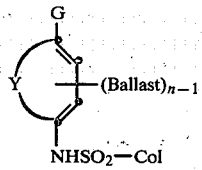

wherein:

Col is a dye or dye precursor moiety;

Ballast is an organic ballasting radical of such molecular size and configuration as to render said compound nondiffusible in said photographic element during development in an alkaline processing composition;

G is $OR_2$ or $NHR_3$ wherein $R_2$ is hydrogen or a hydrolyzable moiety and $R_3$ is hydrogen or an alkyl group of 1 to 22 carbon atoms;

Y represents the atoms necessary to complete a benzene nucleus, a naphthalene nucleus or a 5- to 7-membered heterocyclic ring; and n is a positive integer of 1 to 2 and is 2 when G is $OR_2$ or when $R_3$ is hydrogen or an alkyl group of less than 8 carbon atoms.

27. The process of claim 26 wherein said dye-releasing compound is a p-sulfonamidonaphthol.

* * * * *